US008777523B2

(12) United States Patent
Stephens et al.

(10) Patent No.: US 8,777,523 B2
(45) Date of Patent: Jul. 15, 2014

(54) GEOTEXTILE TUBE WITH FLAT ENDS

(75) Inventors: Thomas C. Stephens, Braselton, GA (US); Benjamin Zachary Dymond, Christiansburg, VA (US); Raymond Herman Plaut, Blacksburg, VA (US)

(73) Assignee: Nicolon Corporation, Pendergrass, GA (US)

( * ) Notice: Subject to any disclaimer, the term of this patent is extended or adjusted under 35 U.S.C. 154(b) by 69 days.

(21) Appl. No.: 12/370,233

(22) Filed: Feb. 12, 2009

(65) Prior Publication Data

US 2009/0208288 A1 Aug. 20, 2009

Related U.S. Application Data

(60) Provisional application No. 61/029,017, filed on Feb. 15, 2008.

(51) Int. Cl.
*E02D 17/20* (2006.01)

(52) U.S. Cl.
USPC ..... 405/302.6; 405/16

(58) Field of Classification Search
USPC ..... 405/16, 17, 19, 80, 107, 111, 112, 114, 405/115, 302.6
See application file for complete search history.

(56) References Cited

U.S. PATENT DOCUMENTS

| | | | |
|---|---|---|---|
| 1,211,853 | A | 1/1917 | Huggins |
| 1,623,107 | A | 4/1927 | Goodykoontz |
| 1,798,094 | A | 3/1931 | Malvern et al. |
| 2,057,748 | A | 10/1936 | Smith |
| 2,069,715 | A | 2/1937 | Arpin |
| 2,323,629 | A | 7/1943 | Spanel |
| 2,645,591 | A | 7/1953 | Makrauer |
| 3,122,297 | A | 2/1964 | Sachs |
| 3,643,440 | A | 2/1972 | Knisse et al. |
| 3,653,216 | A | 4/1972 | Stickler |
| 3,886,751 | A | 6/1975 | Labora |
| 4,434,712 | A | 3/1984 | Ross et al. |
| 4,441,627 | A | 4/1984 | Takeuchi |
| 4,449,847 | A | 5/1984 | Scales et al. |
| 4,690,585 | A | 9/1987 | Holmberg |

(Continued)

FOREIGN PATENT DOCUMENTS

| | | |
|---|---|---|
| EP | 0267661 | 5/1988 |
| EP | 0557401 | 5/1992 |

(Continued)

OTHER PUBLICATIONS

PCT/US03/41791 International, Search Report May 18, 2004.

(Continued)

*Primary Examiner* — Benjamin Fiorello
(74) *Attorney, Agent, or Firm* — Kilpatrick Townsend & Stockton LLP

(57) ABSTRACT

A flexible water-permeable geotextile tube having flat ends when filled with fill material. The tube has separate end panels that are attached to a tube body at the tube body's opposing ends. In one embodiment of this invention, the separate end panels are configured to have the same shape as that of a cross-section of the tube body when the tube body is filled and installed. The cross section of the tube body may be determined before installation by determining the relationship between the height, circumference, the fill material, and the surrounding environment into which the tube is planned to be installed.

37 Claims, 8 Drawing Sheets

(56) References Cited

U.S. PATENT DOCUMENTS

| | | | |
|---|---|---|---|
| 4,772,134 | A | 9/1988 | Jensen et al. |
| 4,784,520 | A | 11/1988 | Stevens |
| 4,878,446 | A | 11/1989 | Vermeulen |
| 4,889,446 | A | 12/1989 | Holmberg |
| 4,966,491 | A | 10/1990 | Sample et al. |
| 5,030,031 | A | 7/1991 | Brown |
| 5,059,065 | A | 10/1991 | Doolaege |
| 5,121,996 | A | 6/1992 | Scarrow |
| 5,158,395 | A | 10/1992 | Holmberg |
| 5,232,429 | A | 8/1993 | Cizek et al. |
| 5,405,217 | A | 4/1995 | Dias et al. |
| 5,505,557 | A | 4/1996 | Bradley |
| 5,584,599 | A | 12/1996 | Knittel |
| 5,605,416 | A | 2/1997 | Roach |
| 5,669,732 | A | 9/1997 | Truitt |
| D393,322 | S | 4/1998 | Suttles |
| 5,865,564 | A | 2/1999 | Miller et al. |
| 5,902,070 | A | 5/1999 | Bradley |
| 5,971,661 | A | 10/1999 | Johnson et al. |
| 6,056,438 | A | 5/2000 | Bradley |
| 6,126,362 | A | 10/2000 | Carter et al. |
| 6,186,701 | B1 | 2/2001 | Kempers |
| 6,200,067 | B1 | 3/2001 | Pena |
| 6,264,251 | B1 | 7/2001 | Kunsman et al. |
| 6,334,736 | B1 | 1/2002 | Johnson et al. |
| 6,364,571 | B1 | 4/2002 | Doolaege |
| 6,547,493 | B2 | 4/2003 | Spangler et al. |
| 6,648,549 | B1 | 11/2003 | Urriola |
| 7,114,879 | B2 | 10/2006 | Obermeyer |
| 2001/0009258 | A1 | 7/2001 | Wakayama |
| 2006/0072969 | A1 | 4/2006 | Obermeyer et al. |
| 2007/0003369 | A1* | 1/2007 | Hanson et al. ..... 405/19 |
| 2007/0237586 | A1* | 10/2007 | Prestininzi ..... 405/115 |

FOREIGN PATENT DOCUMENTS

| | | | |
|---|---|---|---|
| EP | 1350892 | | 10/2003 |
| JP | 040203023 | | 7/1992 |
| JP | 2000017631 | A * | 1/2000 |
| WO | WO-8905042 | | 6/1989 |

OTHER PUBLICATIONS

Plaut, et al., "Two-dimensional analysis of geosynthetic tubes", *Acta Mechanica* , 129, 207-218 (1998).

* cited by examiner

GEOTEXTILE TUBE WITH FLAT ENDS

CROSS REFERENCE TO RELATED APPLICATIONS

This application claims priority to U.S. provisional application Ser. No. 61/029,017, entitled "Geotextile Tube with Flat Ends," filed Feb. 15, 2008, the entire contents of which are hereby incorporated by this reference.

FIELD OF INVENTION

Various aspects and embodiments of the present invention relate to geotextile tubes.

BACKGROUND

Beaches and other land forms that surround large bodies of water have always been subjected to severe erosion caused by the currents and waves. Erosion can lead to massive amounts of beachfronts disappearing, leaving higher ground exposed to the full energy of waves. The exposure to wave energy can lead to further erosion of the higher ground and possible damage to adjacent structures. Many attempts have been made to prevent such erosion from occurring. Marine structures have been developed to dissipate the power of the waves and shield the shoreline from waves. However, many of these structures, such as jetties and sea walls, have their own shortcomings. Solid structures, like jetties, are constructed of rocks and concrete blocks and are expensive to build and install. Additionally, such structures are massive in size, can further disrupt the environment, and can be visually unappealing. Also, the solid nature of these structures may lead to further erosion; the force of the waves is redirected, and not dissipated, to the bottom of the structures, causing erosion at the base of the solid structure.

Soft structures, like ballast-filled tubes, have been developed to solve many of the problems mentioned above. In order to withstand the constant pounding of waves, these tubes should be manufactured from a liquid permeable material having sufficient tensile strength, seam strength, and wear resistance. Geotextiles are one type of material that fit such criteria. When constructed, the geotextile tubes are filled with a ballast material, such as sand slurry and concrete. While the tubes create a wave barrier, the permeable nature of the tubes, in combination with the fill material, absorb much of the energy generated by crashing waves, leading to a greater reduction in erosion above and below the geotextile tube. The geotextile tubes also provide a much more cost-effective solution than solid structures.

While the geotextile tubes may be a better alternative than the solid structures mentioned above, their current construction and installation have several drawbacks. The size of geotextile tubes is constrained based upon the tensile strength of the geotextile as well as the stress limits of the seams. Therefore, in most cases, marine structures require the installation of multiple geotextile tubes. However, the construction of geotextile tubes does not aid in their modularity. Traditionally, each tube is manufactured from one continuous piece of fabric by folding the fabric in half and then securing the adjacent edges together. When filled with slurry, the ends of the geotextile become pinched, forming a geotextile tube 10 with sloping ends 12, as shown in FIG. 1. Since the geotextile tubes 10 do not have a uniform cross-section across their length, placing them end to end does not result in a barrier with a uniform height and level top, which is essential to form an effective barrier against wave energy. Additionally, many marine structures require a greater height than that provided by one tube, which requires tubes to being stacked on one another. When tubes are placed over the junctions of the sloping ends, the upper tubes sag into the spaces between the lower tubes, creating a top surface with non-uniform height.

To combat this shortcoming, the tapered ends 12 of the traditional geotextile tubes 10 are overlapped with one another, as shown in FIG. 2, creating additional problems. By overlapping, each geotextile tube's effective length is diminished, requiring more geotextile tubes to be used to form the needed marine structure at a greater cost. Second, gaps can be created between the tubes by the overlapping, hindering the overall performance of the marine structure. In order to achieve a gap-free junction and a structure with a relatively continuous flat top, smaller geotextile tubes 20, as shown in FIG. 3, are used to fill the gaps created by the overlapping, which increases installation costs. Third, the overlapping increases the difficulty of anchoring and securing the ends of the geotextile tubes during installation, which can increase the chances of compromising the integrity of the junctions formed between adjacent geotextile tubes. Unsecured overlapping in stacked multiple tubes can further compromise the structural integrity of the overall protective structure and may be unsightly.

Therefore, there is a need for geotextile tubes that when placed end to end form gapless junctions. Additionally, there is a need for geotextile tubes that may be filled to a uniform height.

SUMMARY

The present invention addresses these problems and concerns by providing a flexible water-permeable tube having flat ends when filled with fill material, a method of making such a tube, and a method of installing the tube. The tube has separate end panels that are attached to a tube body at the tube body's opposing ends. In one embodiment of this invention, the separate end panels are configured to have the same shape as that of a cross-section of the tube body when the tube body is filled and installed. Having the shape of the end panels mirror the cross-sectional shape of the tube body leads to a tube having a uniform cross section along the length of the tube and a uniform height upon receipt of fill material. The cross section of the tube body may be determined before installation by determining the relationship between the height, circumference, the fill material, and the surrounding environment into which the tube is planned to be installed.

DETAILED DESCRIPTION

Embodiments of this invention provide tubes having substantially flat ends for installation along shorelines for erosion prevention and shelter from waves. While the preferred embodiments of the tubes discussed are for use in erosion protection, the tubes are in no way limited to such use. The tubes may be used in other marine structures, such as berms, breakwaters, bunds, cores for sand dunes, dykes, and jetties. Also, the tubes may be used for other various purposes other than barriers or support, such as, but not limited to, containment and dewatering.

Figure 4:
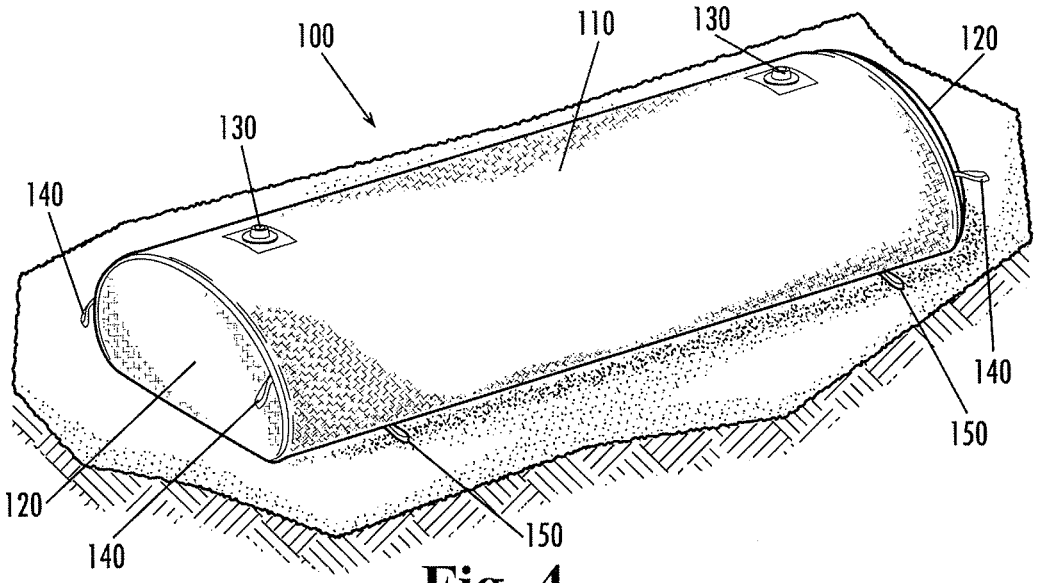
FIG. 4 is a perspective view of a geotextile tube according to an embodiment of the invention.
Figure 5:
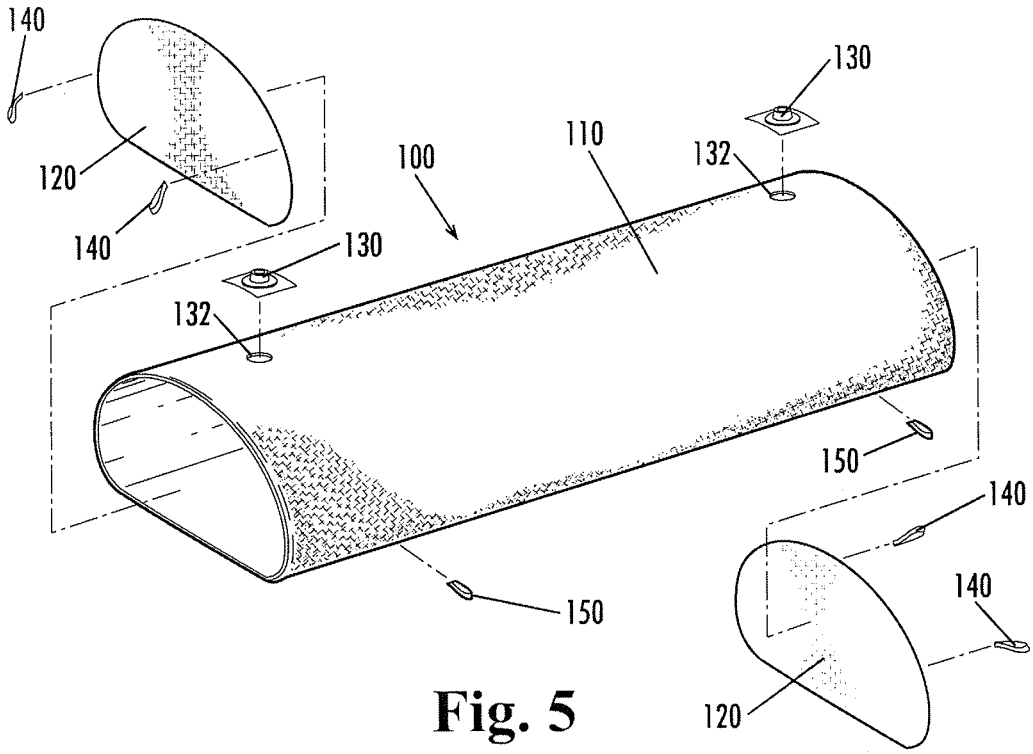
FIG. 5 is an exploded perspective view of the tube of FIG. 1.

FIGS. 4 and 5 illustrate a tube 100 according to one embodiment of the present invention. The tube 100 has a cylindrical tube body 110 and end panels 120 that are substantially flat in the vertical direction when the tube is filled. The dimensions of the tube 100 vary depending on its intended use, as will be discussed below. The tube 100 may also include a number of fill ports 130 oriented at openings 132 within the tube body. The fill ports 130 allow a pump to connect to the tube 100 to fill the tube's interior with various fill materials, such as sand slurry. An example a fill port is discussed in U.S. patent application Ser. No. 11/258,525, entitled "Methods, Systems, and Apparatus for a Fill Port for a Flexible Container," the entire content of which is incorporated by this reference. Attachment ties 140 may also be found around the circumference of the end panels 120, providing a means for securing adjacent tubes 100 to one another. Anchor ties 150 may be found along the bottom portion of the tube body 110, which allow the tube 100 to be temporarily secured to the underlying structure while being filled.

The tube body 110 and the end panels 120 of the tubes 100 are made from a flexible fabric. By making the tube 100 from a flexible fabric, transportation and construction costs are kept to a minimum. While the tubes may be made from any type of flexible fabric, it is preferable that the flexible fabric be water permeable, further assisting in the dissipating of the power of the waves that the tubes encounter. Given the strength of the waves, as well as the stress applied on the interior by the fill material, it is also desirable to build the tubes from a sturdy fabric. Appropriate geotextile materials have the flexibility, water permeability, and tensile strength to satisfy these needs. For example, Tencate's Geotube® fabrics GT500M, GT600M, GT750M, GT1000M, and GT100MP may be used. It is preferred that the geotextile material used is made from, but not limited to, polypropylene, polyethylene, or polyester.

Figure 1:
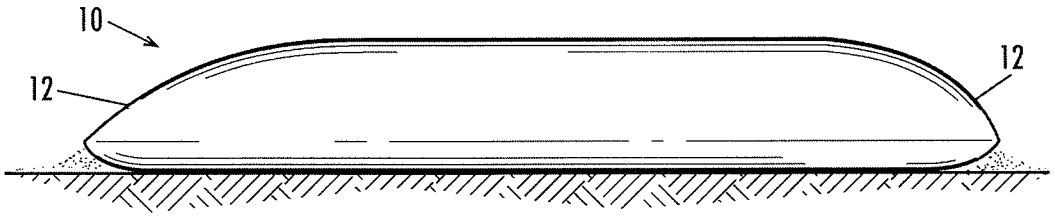
PRIOR ART Fig. 1
FIG. 1 is a perspective view of a prior art geotextile tube.
Figure 2:
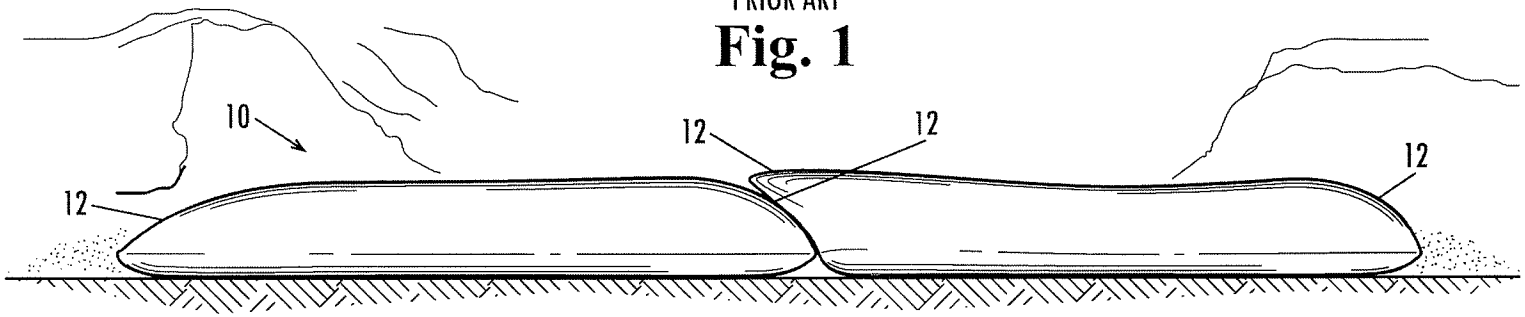
PRIOR ART Fig. 2
FIG. 2 is a perspective view of two overlapped geotextile tubes of the type shown in FIG. 1.
Figure 3:
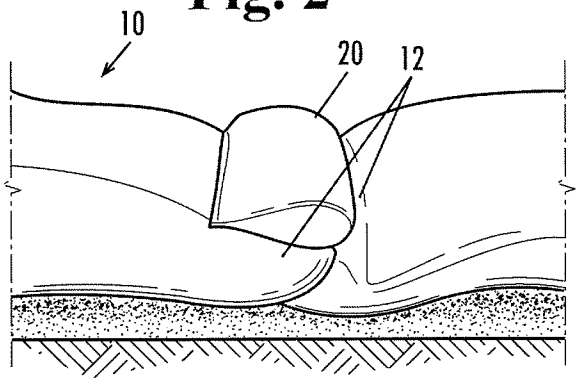
PRIOR ART Fig. 3
FIG. 3 is a perspective view of the geotextile tubes of FIG. 2 with a prior art smaller geotextile tube.

As shown in FIGS. 4-5, the tube body 110 and the end panels 120 of the tube 100 are separate components. By attaching the separate end panels 120 to the ends of the formed tube body 110, the tube body 110 is not pinched like the ends 12 of the traditional tube 10 shown in FIG. 1. When the tube 100 is filled, the combination of the tube body 110 and end panels 120 results in substantially vertically flat ends. The vertically flat ends allow the tubes 100 to be placed end to end with one another to create a relatively flush junction between adjacent tubes 100, eliminating any gaps.

Figure 6:
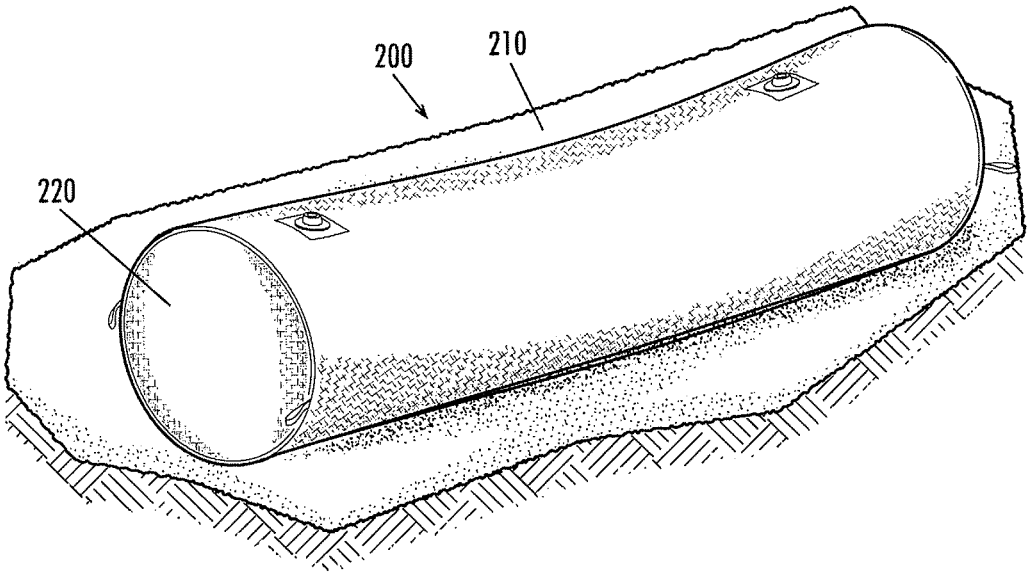
FIG. 6 shows a perspective view of a geotextile tube according to another embodiment of this invention.

Although they are separate components, the dimensions of the end panels 120 are determined by the cross-sectional shape of the tube body 110 when filled. Having the dimensions of the end panels 120 match the cross-sectional shape of the tube body 110 allows the tube 100 to have a continuous uniform cross-sectional shape and height from end to end when filled with a ballast material. However, tubes 200 according to other embodiments of this invention, as shown in FIG. 6, may have end panels 220 that form gapless junctions between adjacent tubes that do not match the cross-sectional shape of the tube body 210 when filled. While it is possible to have tubes 200 without a uniform cross-sectional shape, having a tube with a uniform cross-sectional shape makes installation of multiple tubes easier and ensures a more structurally sound erosion prevention structure, especially when tubes are stacked on one another.

To ensure that the tube 100 has a uniform cross-section along its length, the dimensions of the end panels 120 are based upon the cross-sectional shape of the tube body 110 when the tube body 110 is filled. Since the tube body 110 is made from a fabric, it has limited or no rigidity. When filled with a ballast material, the tube body 110 is subjected to several different forces that impact the tube body's cross-sectional shape. First, the fill material applies an internal hydrostatic pressure to the interior surface of the tube body 110. Second, the surface on which the geotextile tube rests applies an additional force that shapes the bottom of the tube. Additionally, the surrounding environment in which the tube is placed can apply additional forces. For example, if the tube is placed in a completely submerged location, surrounding water applies a force that has an impact on the tube's shape when filled. When the tube is used as a core for a sand dune, the surrounding sand applies forces that shape the tube as well.

An analysis of a geosynthetic tube based upon certain known criteria may be performed to determine the cross-sectional shape and dimensions of a yet-to-be-filled tube body 110. The cross sectional shape may be determined by using a variety of mathematical formulas known to those skilled in the art. For example, "Two dimensional analysis of geosynthetic tubes," by R. H. Plaut and S. Suherman, *Acta Mechanica*, vol. 129, n°3-4, pp. 207-218 (1998), the entire contents of which are hereby incorporated by this reference, discusses a combination of formulas used to determine the cross-sectional shape of a geosynthetic tube based upon a number of predetermined inputs, constants, and known relationships. The formulas needed to calculate the cross-sectional shape of the tube take the constants and predetermined inputs to predict the pressure applied to the tube body along various points along its surface through the known relationships.

Figure 7:
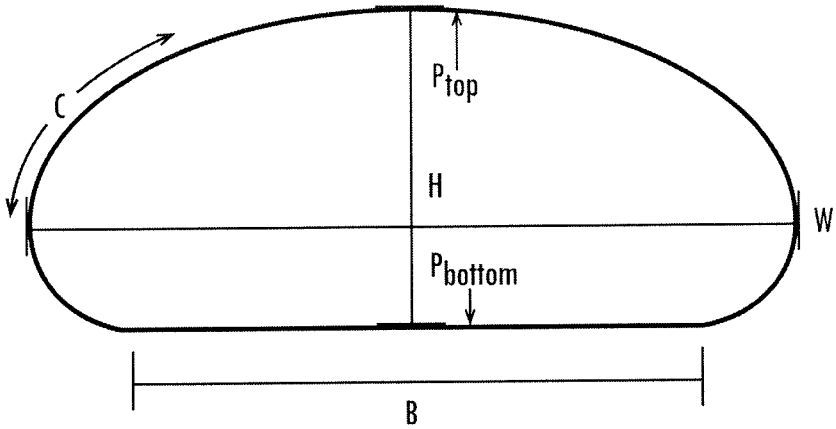
FIG. 7 is a graph of a cross-section of a tube according to one embodiment of this invention.

For one embodiment of this invention, the predetermined inputs are the height of the tube H, its circumference L, the specific gravity of the ballast material to fill the tube $SG_{int}$, and whether or not the tube will be submerged, which determines whether water or other material, which has a specific gravity $SG_{ext}$, will surround the tube. The values that are being sought are the pressure applied at the bottom of the tube $P_{bot}$, the pressure applied at the top of the tube $P_{top}$, the width W of the geotextile tube at its widest point when filled, the width of the contact area between the tube and the supporting surface B, and the area A of a cross section of the tube. Additionally, the circumferential tension per width perpendicular to the cross section T is another value that needs to be calculated. Some of the desired values are represented in FIG. 7.

In terms of geometrical considerations, horizontal coordinate X, vertical coordinate Y, and the angle between the horizontal and the tangent to the tube θ are useful values to calculate. All three quantities vary as the arc length S of the exterior of the tube from a starting point changes. For the geometrical considerations, the change of X and Y as S changes can be represented by the following formulas:

$$\frac{dX}{dS} = \cos\theta \quad \frac{dY}{dS} = \sin\theta$$

To assist in the process of determining the cross-sectional shape of the tube, the values are calculated in non-dimensional quantities, as shown below.

$$h = \frac{H}{L}$$

$$w = \frac{W}{L}$$

$$b = \frac{B}{L}$$

$$a = \frac{A}{L^2}$$

$$p_{bot} = \frac{P_{bot}}{SW_{int}L}$$

$$t = \frac{T}{SW_{int}L^2}$$

$$x = \frac{X}{L}$$

$$y = \frac{Y}{L}$$

$$s = \frac{S}{L}$$

$SW_{int}$ is the specific weight of the fill material, which is produced by multiplying $SG_{int}$ by the weight per unit volume of water. The specific weight of the surrounding material $SW_{ext}$, is found by multiplying $SG_{ext}$, by the weight per unit volume of water. Along those same lines, the non-dimensional terms of the changing of the geometrical considerations become the following:

$$\frac{dx}{ds} = \cos\theta \quad \frac{dy}{ds} = \sin\theta$$

When trying to solve this problem in terms of bottom pressure, the solution can be written in terms of elliptic integrals. For example, as θ increases as s increases, $p_{bot}$ can be calculated from the following formula.

$$p_{bot} = \frac{1}{2[K(k) - E(k)]} \quad \text{(Equation 1)}$$

K(k) and E(k) are complete elliptic integrals of the first and second kind, respectively, and are well known in the art. Parameter k is defined by the following term.

$$k = \frac{2\sqrt{t}}{p_{bot}} \quad \text{(Equation 2)}$$

With these formulas, the non-dimensional contact length b, height h, and width w of the tube can be computed from the following equations.

$$b = 1 - 2k\sqrt{t}\,K(k) \quad \text{(Equation 3)}$$

$$h = (1 - \sqrt{1 - k^2})\,p_{bot} \quad \text{(Equation 4)}$$

$$w = b + 2\left[E(\pi/4, k) - \left(1 - \frac{k^2}{2}\right)F(\pi/4, k)\right]p_{bot} \quad \text{(Equation 5)}$$

$$a = bp_{bot} \quad \text{(Equation 6)}$$

$$F(\pi/4, k) \text{ and } E\left(\frac{\pi}{4}, k\right)$$

are elliptic integrals of the first kind and second kind, as is well known in the art.

With h the only non-dimensional variable found in the equations above that is known, k can be related to h by substituting Equation 1 for $p_{bot}$ in equation 2, as shown below.

$$\frac{1}{2[K(k) - E(k)]} = \frac{h}{(1 - \sqrt{1 - k^2})} \quad \text{(Equation 7)}$$

For a specified value of h, Equation 7 can be solved numerically for the corresponding value of k by using mathematical software, such as Mathematica®. With a numerical value for k, $p_{bot}$ can be computed from Equation 1, t from Equation 2, b from Equation 3, w from Equation 5, and a from Equation 6. The corresponding dimensional quantities can then be calculated from these outputs.

For example, when H=7 ft, L=60 ft, $SG_{int}$=1.4, and the tube is to be emerged, or exposed above water, resulting in $SG_{ext}$=1.0, the following values for the other dimensions and properties of the tube can be calculated.

| Non-dimensional quantity | Value | Dimensional quantity | Value |
|---|---|---|---|
| h | .11667 | H | 7 ft |
| $P_{bot}$ | .11955 | $P_{bot}$ | 4.352 psi |
| w | .44392 | W | 26.64 |
| b | .38400 | B | 23.04 |
| t | .00357 | T | 93.59 lb/in |

Some approximate formulas not requiring the use of elliptic integrals may be derived and used to solve for the needed quantities. The non-dimensional height h can be varied and the corresponding quantities $p_{bot}$, t, b, h, w and a can be computed using Equations 1-6. A table of all the values can be set up in a spreadsheet program, such as Excel, and curves can be drawn for each quantity as a function of h. A polynomial function can be used by the spreadsheet program to closely approximate each curve, or portions of each curve. These polynomial functions can then be used by the spreadsheet to obtain the output quantities that are desired.

As the unknown variables are being solved, the shape of the cross-section of the geotextile tube may be plotted. According to one embodiment of the invention, the x and y coordinates of the cross-section can be determined using the following formulas.

$$x = \left[E(\phi, k) - \left(1 - \frac{k^2}{2}\right)F(\phi, k)\right]p_{bot} \quad \text{(Equation 8)}$$

-continued $$y = \left(1 - \sqrt{(1 - k^2 \sin^2 \phi)}\right) p_{bot} \quad \text{(Equation 9)}$$

The shape of the cross-section of the tube is obtained by varying $\phi$ from 0 to $\pi$.

Figure 8:
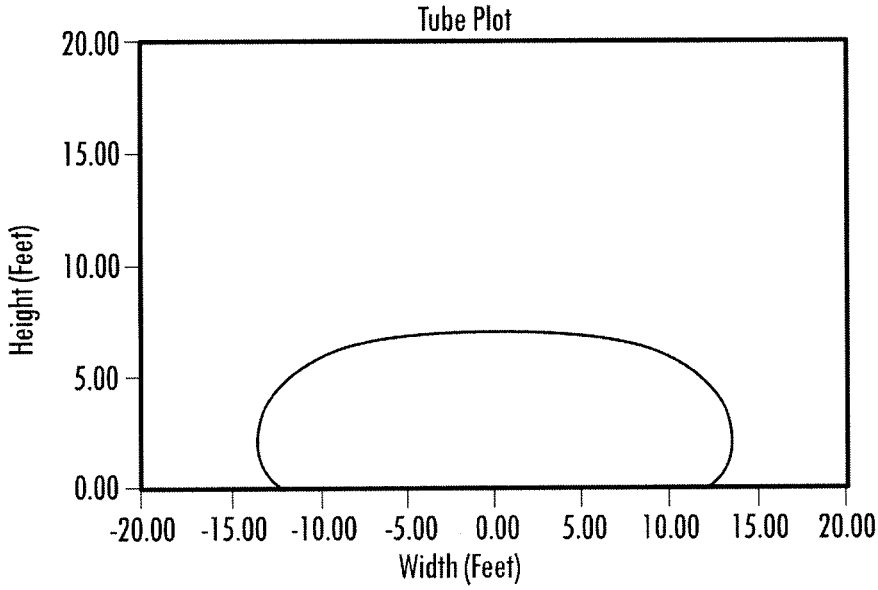
FIG. 8 is a scalar representation of a cross-section of a tube according to one embodiment of this invention.

The plotting of the shape may be determined without using elliptic integrals. The formulas below provide one example on how to do so.

$$y(r) = L\left[p_{bot} - \sqrt{(p_{bot}^2 - 2t + 2t\cos(r))}\right] \quad \text{(Equation 10)}$$

$$x(r) = L\left(\frac{b}{2} + tJ\right) \quad \text{(Equation11)}$$

$$\text{where } J = \int_0^r \frac{\cos(r)}{\sqrt{(p_{bot}^2 - 2t + 2t\cos(r))}} dr \quad \text{(Equation 12)}$$

r is varied between 0 and $2\pi$ to generate a number of x and y coordinates. Using the values described above in the table, FIG. 8 provides a plot of the cross-sectional shape. The generated plot may be used to create a to-scale model, from which an end panel template can be extrapolated.

The above formulas, or other derived formulas, may be used in an end panel dimension algorithm to generate the dimensions needed for an end panel 120 to match the cross sectional shape of the tube body 110. The end panel dimension algorithm may be controlled through a computer program, such as Tencate's Geotube Simulator® program. While the preferred embodiment of this invention uses variations of the formulas and variables shown above, other variables and equations known to those skilled in the art may be used to determine the cross-sectional shape of the tube body according to other embodiments of this invention.

Before the dimensions of the cross-sectional shape of the tube body 110 can be calculated, the needed inputs must be determined. In the preferred embodiment, the height H and circumference L of the tube, the specific gravity $SG_{int}$ of the fill material, and the specific gravity $SG_{ext}$ of the material to surround the tube, if any, must be determined.

The overall height of the structure will have an impact on the height of an individual tube. Structures that are built with tubes can range in height from a few feet to over 30 feet. However, for cost and safety reasons, it is preferable to keep the height of an individual geotextile tube between 3 ft and 10 ft. When structures require a height greater than this range, multiple tubes stacked on one another are needed.

Safety concerns have a major impact on the circumference L of the tube. One of the major safety concerns with any filled geotextile tube is the possibility of the tube rupturing. Rupturing mainly occurs at the seams of the tube when the force applied by the fill material is too great for the seam to handle. Therefore, the seam strength, that is the amount of force the seam can withstand before rupturing, needs to be much greater than the force of the fill material applied at the seams to prevent seam ruptures. Preferably, a four-to-one seam strength to fill material force ratio is desired. The seam strength is determined by the tensile strength of the tube fabric and the type of seam employed. However, by increasing the circumference L of the tube while keeping the height H constant, the amount of force applied against the seam decreases. The circumference L is determined with these factors in mind.

Where the structure utilizing the tubes is being built determines the specific gravity $SG_{int}$ of the fill material as well as the specific gravity $SG_{ext}$ of the surrounding environment. Tubes are generally filled with fill material located at the installation sight. Since most of the structures utilizing the tubes are built near beaches, sand is usually the fill material used. However, other fill material, such as, but not limited to, sediment, dirt, and other particulate matter, may be used. Therefore, the specific gravity $SG_{int}$ of the fill material used, which can vary from location to location, must be determined. Whether the geotextile will be fully submerged in an underwater environment or whether it will be partially exposed to air determines the $SG_{ext}$ of the material forced against the outside surface of the geotextile tube. If any part of the geotextile tube will not be submerged, the geotextile tube should be considered emerged, or entirely exposed, for safety purposes.

With the inputs needed to determine the shape of the cross-sectional shape provided, the length of the geotextile tube can then be determined. The tube's length may also be determined by the environment as well. Generally, tubes are installed in lengths between 60 and 200 ft. However, the size can vary based upon convenience. For example, for installation in strong water current areas, the length is usually shorter to avoid as much of the force applied by the moving water. In situations where there is little to no current, the length of a single geotextile tube can reach approximately 200 ft. The length of the tube can also impact the number of fill ports needed. More fill ports are needed the longer the tube to ensure an equal distribution of fill material within the tube. The height H of the geotextile tube can be adjusted along the same lines of convenience.

Figure 9:
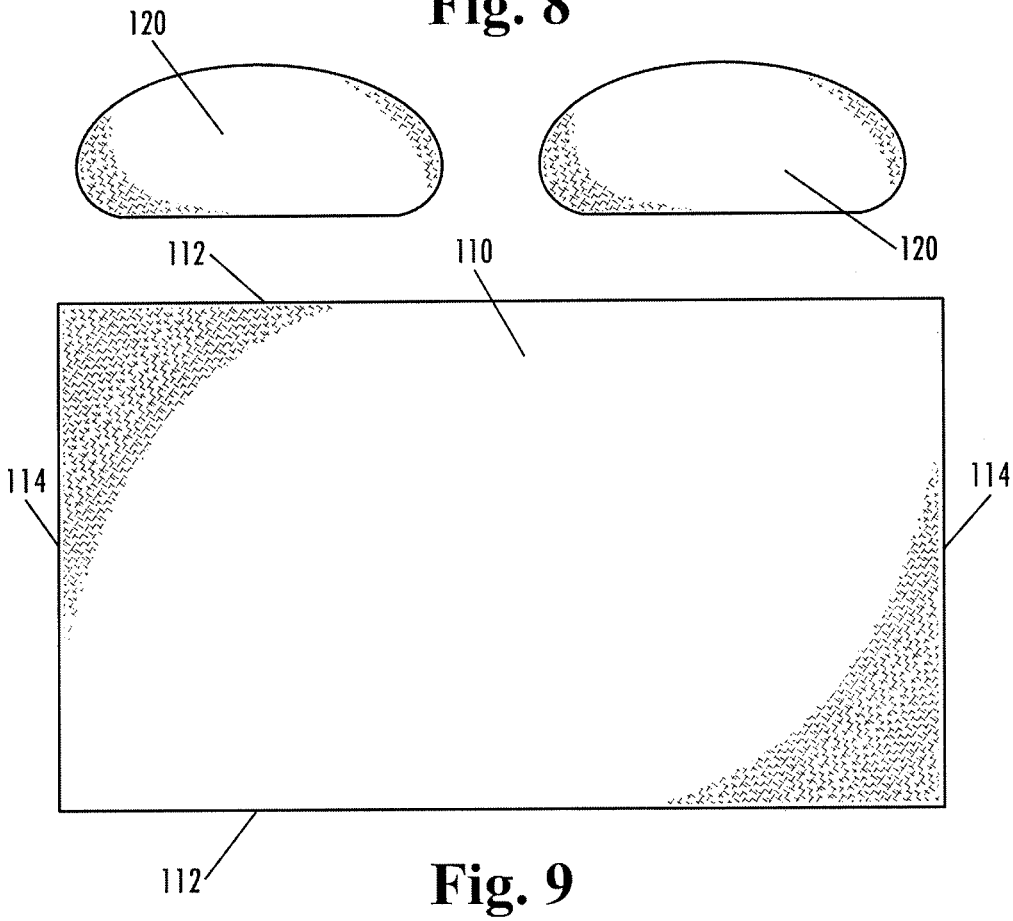
FIG. 9 is a schematic view of the components of a geotextile tube according to one embodiment of this invention.

Once the dimensions of the tube have been determined, the geotextile tube 100 can be constructed. The tube body 110 and the end panels 120 are formed from separate components, as shown in FIG. 9. The tube body 110 may be formed from a rectangular piece of fabric having longitudinal edges 112 and lateral edges 114. The tube body 110 is formed by securing the longitudinal edges 112 to one another. Any suitable means (for example, heat seaming, gluing, ultrasonic welding, etc.) may be used to secure the longitudinal edges 112 together. Once the tube body 110 has been formed, the end panels 120 may be attached to the lateral edges 114 or tube ends in the same way. Fill ports 130 may be added along various portions of the tubes 100. However, in the embodiment as shown in FIGS. 4-5, such fill ports 130 are oriented along the top of the tube body 110, for accessibility. To add the fill ports 130, corresponding openings 132 must be made in the tube body 110. Attachment ties 140 may also be added along the ends of the tube 100 in the vicinity of the end panels 120. Anchor ties 150 may be added along the bottom portion of the tube body 110. The attachment ties 140 and anchor ties 150 can be made from cloth, wire, cable, chain, straps, and other types of material. Additionally, the loops and ties may include fasteners, buckles, clips, snaps, and other securing devices.

While many means of securing may be used, sewing, which forms seams, will generally result in bonds between the components of the tube with the strength necessary to withstand the pressures exerted on them. The type of seam chosen may depend on, among other considerations, the foreseeable stresses to which the tube 100 may be subjected. The strength of the resulting seams can be impacted by a number of factors, including the type of seam, the type of stitch, the type of thread, and the stitch density.

Many types of seams may be used in the manufacture of the tube 100 of this invention. Examples of such seams are discussed in U.S. application Ser. No. 10/541,134,, filed Apr. 6, 2006, entitled "Inlet Port for a Container Made of Geotextiles", the entire content of which is incorporated by this reference. A "flat" or "prayer" seam is formed by placing together the facing edges of two textiles. A "butterfly" seam is formed by placing together the facing edges of two textiles and then folding a portion of each textile back onto itself. This creates four layers of textile that can then be secured together. A "J" seam is formed by placing together the facing edges of two textiles and then folding a portion of both onto one of the textiles. The "J" seam and "butterfly" seam, while generally more difficult to form than a prayer seam, are preferable in applications where stronger seams are necessary, and are preferable in the construction of the tubes. An "overlap" seam is formed by overlapping the edges of two adjacent textiles and securing them together in the area of overlap. These seams, among others, may also be used to secure the openings at which the fill ports 130 are attached to the tubes 100. Independent of the seam-type used, the seam should be a reversed, placing the protruding portions within the interior of the tube.

Any type of suitable stitching that imparts sufficient strength to seams may be used. A double-thread lockstitch has been found to be particularly effective. Moreover, any thread that will provide sufficient seam strength may be used. For example, Kevlar, nylon, polyester or polypropylene threads, among others, are all suitable. The ply and denier of the thread used may vary depending on the thread material and the seam strength desired. One thousand (1000) denier polyester thread has been found to be effective for stitching the components of the tube 100.

Any stitch density suitable to the particular material, thread and seam strength desired may be used. Stitches that are too close and/or thread tensions that are too tight tend to cut the geotextile material. Stitch densities of at least 4 to 5 stitches per inch have been found sufficient to impart the necessary strength to the seam. However, higher stitch densities may be desirable for use with geotextiles having heavier, tighter base yarns, and lower stitch densities may be desirable for use with lighter geotextiles.

Figure 10:
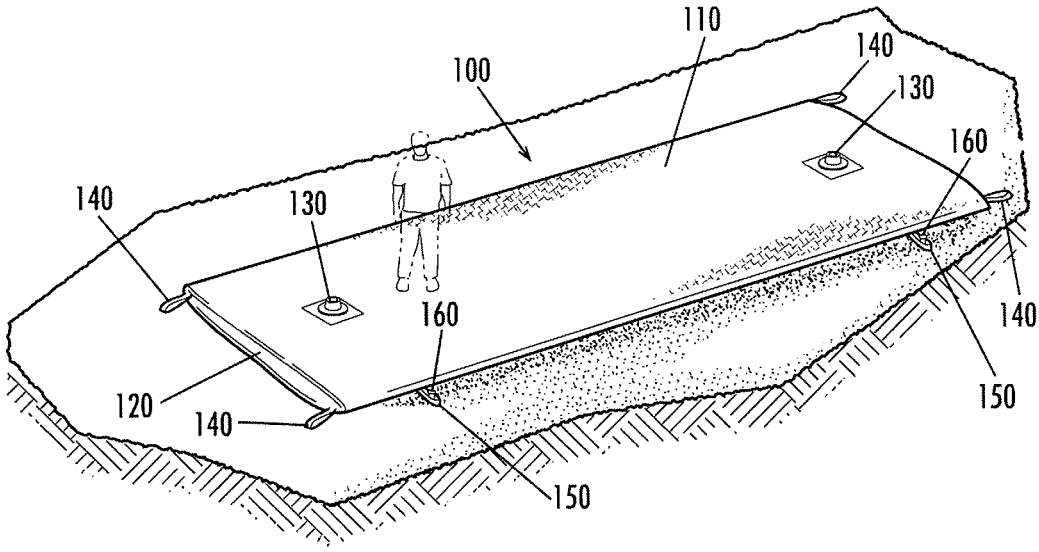
FIG. 10 is a perspective view of an unfilled geotextile tube according to one embodiment of this invention.
Figure 11:
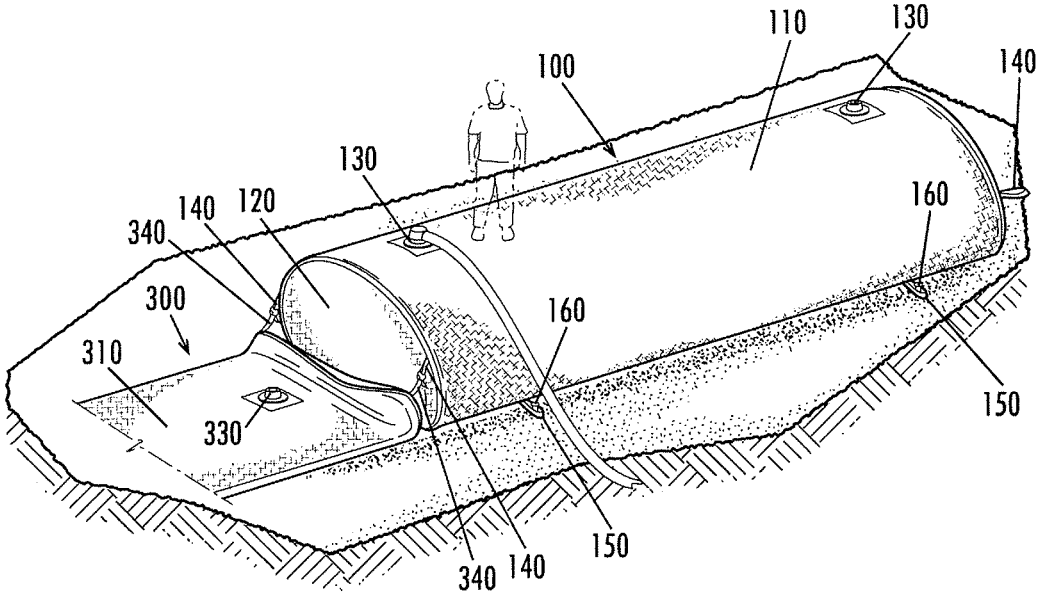
FIG. 11 is a perspective view of a filled tube adjacent an unfilled tube according to one embodiment of this invention.
Figure 12:
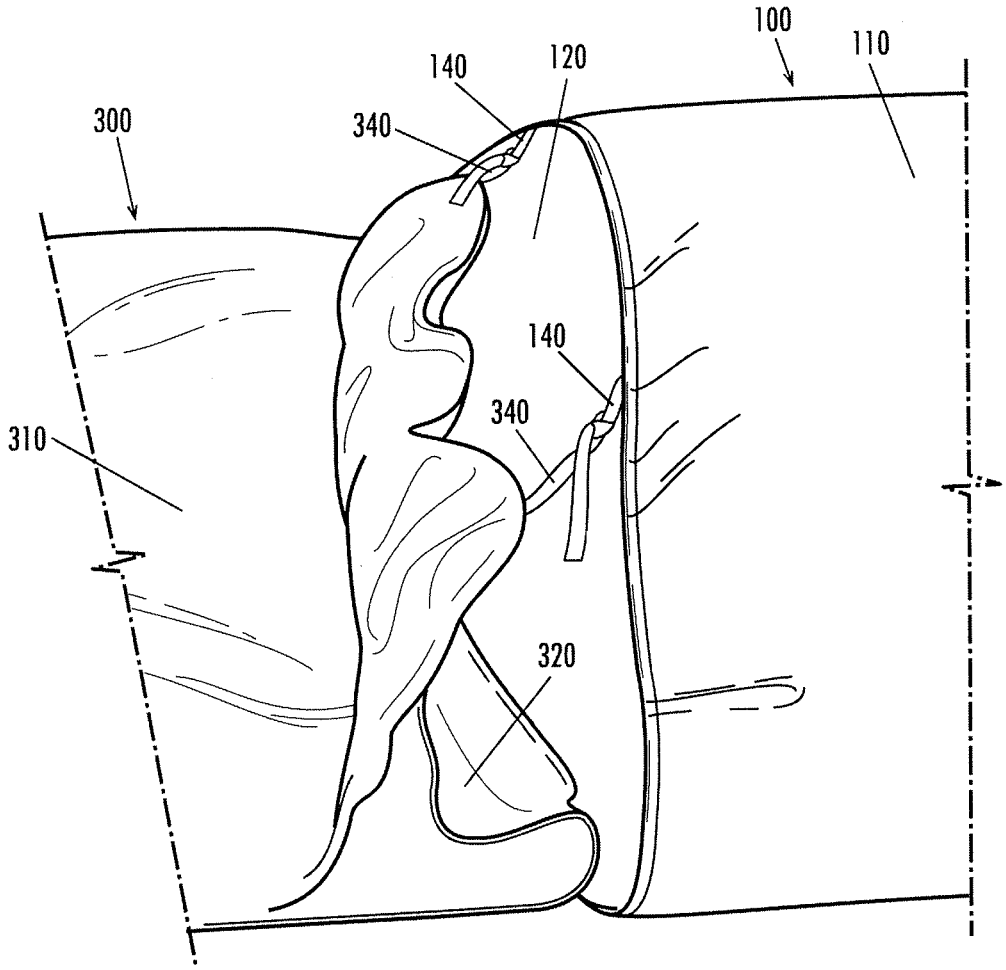
FIG. 12 is a perspective view of the adjacent ends of the geotextile tubes of FIG. 11.

FIGS. 10-12 illustrate how to install multiple geotextile tubes 100 for erosion prevention according to one embodiment of the invention. First, the area of installation needs to be prepared. A level surface should be provided. Debris that could impact the structurally integrity of the tube, as well as impact the uniform height of the tubes, should be removed. A canal should be prepared for the placement of the tube when used as a core for dune construction. When the structure is being placed in an area of high erosion, a scour apron with its own anchors may be installed.

Once the area has been prepared, an unfilled tube 100 is provided and placed in the desired area, as shown in FIG. 10. In some environments, the unfilled tube 100 will need to be temporarily secured before filling. The anchor ties 150 found along the bottom of the tube 100 may be secured to an anchor, shown as stakes 160, in FIG. 10. However, the anchor ties 150 may use other devices than stakes, such as, but not limited to, weights, hooks, and anchors that assist in retaining the tube 100 in place before filling. After placement, the tube is then filled with a ballast material, such as sand slurry. Sand slurry may be filled through the assistance of a sand slurry pump, which may be attached to the tube at a fill port 130. With the weight of the fill material firmly retaining the filled geotextile tube in place, the temporary securing means may be removed.

Figure 13:
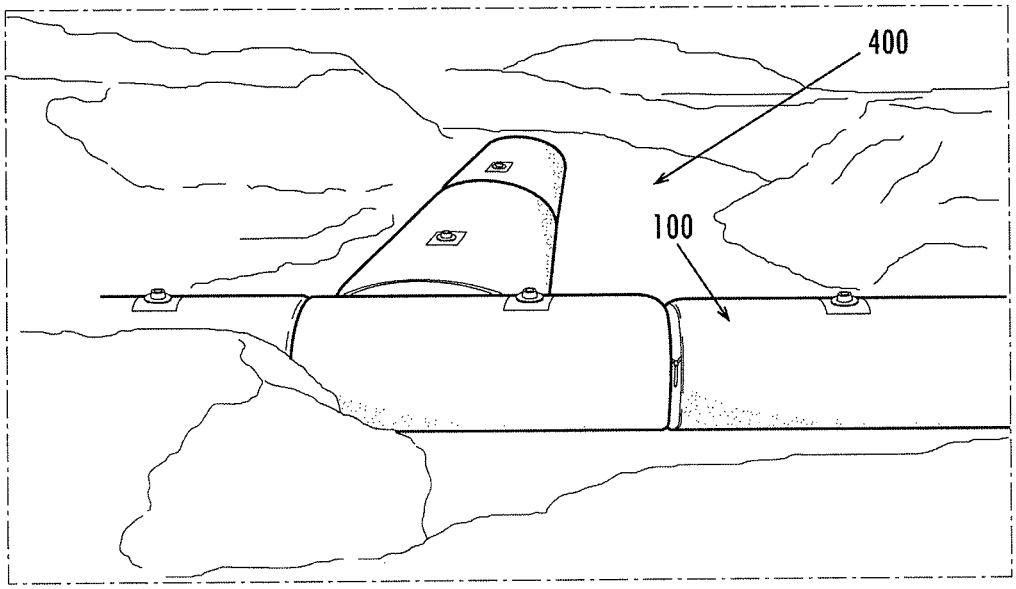
FIG. 13 is a perspective view of tubes installed according to one embodiment of this invention.

After the tube has been filled, a second tube 300 may be placed adjacently, end to end with the first tube 100, as shown in FIG. 11. If needed, the second tube 300 may be temporarily anchored as described above. The attachment ties 140 of the first tube 100 may be secured with the attachment ties 340 of the second tube 300 at this time as shown in FIG. 12. However, it is possible to attach each tube to one another before either is filled. While securing the attachment ties 140 and 340 of the adjacent geotextile tubes may be done after both are filled, it is extremely difficult given that there is no gap between the two tubes in which to gain access. The second tube 300 may then be filled with the fill material until the two adjacent tubes are essentially level with one another. When installation of the tubes is completed, as shown in FIG. 13, a structure 400 having a uniform height from end to end is created. A uniform height results in an improvement in the function and the appearance of the structure 400.

Figure 14:
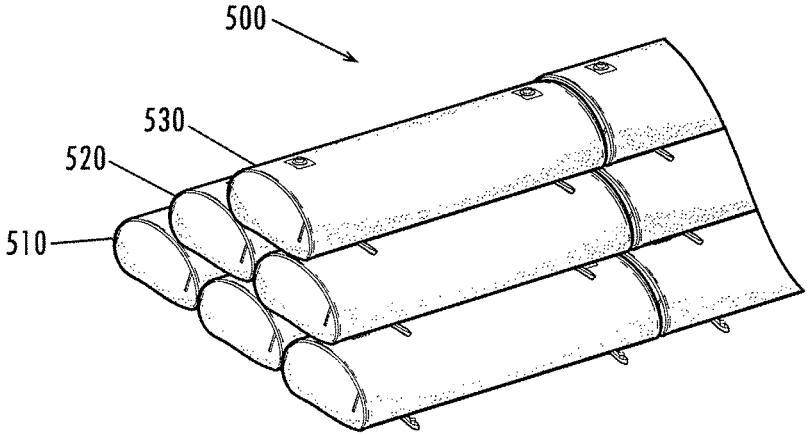
FIG. 14 shows another perspective view of tubes installed according to another embodiment of this invention.
Figure 15:
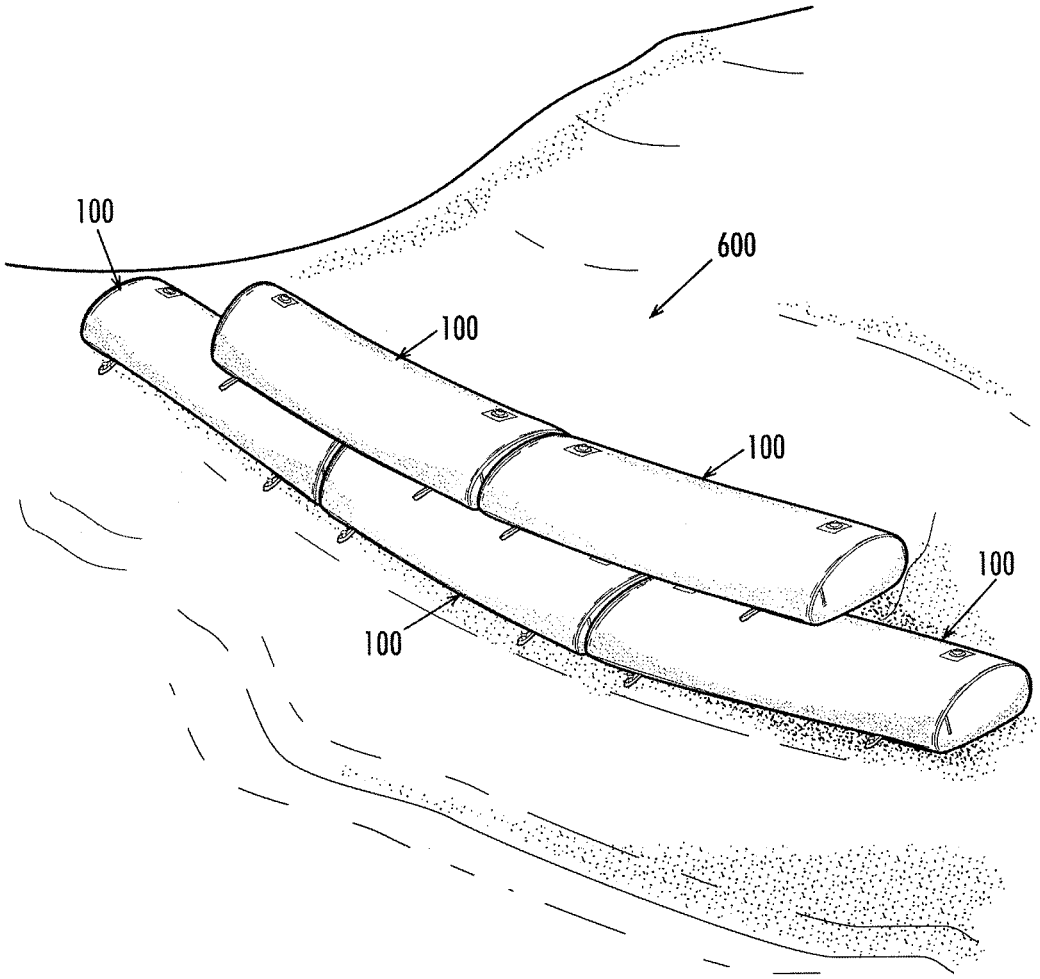
FIG. 15 shows another perspective view of tubes installed according to another embodiment of this invention.

When the height of the overall structure requires more than one layer of tubes, stacking tubes in a pyramid fashion, as shown in FIG. 14, is a preferable method of installation. The structure 500 is made of multiple layers with each layer having one more tube than the layer above it. When three layers of tubes are needed, a bottom layer 510 will have three tubes side by side, a middle layer 520 will have two tubes side by side, and a top layer 530 will only have one tube. While stacking the tubes in a pyramid fashion is preferred, not all structures that require a height greater than provided by a single tube requires it. For example, the structure 600 of FIG. 15 shows staggered tubes 100 along a sloped surface. Other tube orientations are possible, and are by no means limited to the structures discussed above.

The foregoing is provided for purposes of illustrating, explaining, and describing embodiments of the present invention. Further modifications and adaptations to these embodiments will be apparent to those skilled in the art and may be made without departing from the scope or spirit of the invention.

What is claimed is:

1. A geotextile tube comprising a flexible fabric and adapted to receive a fill material, comprising:

a. a tube body comprising the flexible fabric and two opposing ends; and b. two non-rigid end panels, each comprising the flexible fabric and each one of which is attached to each of the opposing ends of the tube body, wherein:

upon receipt of the fill material, the geotextile tube is adapted to assume a tube shape having flat ends, the flat ends are formed by the two non-rigid end panels, the flexible fabric of the geotextile tube is self-supporting of the tube shape, and the geotextile tube is water-permeable.

2. The tube of claim 1, wherein the two non-rigid end panels further comprise a shape corresponding to a cross-sectional shape of the tube body upon receipt of the fill material.

3. The tube of claim 2, wherein the cross-sectional shape of the tube body is determined by a relationship between the fill material, an environment in which the tube is placed, a height of the tube, and a circumference of the tube body when the tube body receives the fill material and is placed in the environment.

4. The tube of claim 3, wherein the tube body is formed from a single panel of the flexible fabric comprising longitudinal opposing edges secured to one another and lateral opposing edges forming the two opposing ends of the tube body.

5. The tube of claim 1, further comprising at least one attachment tie attached to one of the two non-rigid end panels or to the tube body near the one of the two non-rigid end panels.

6. The tube of claim 1, further comprising at least one fill port associated with a top portion of the tube body and configured to receive the fill material.

7. The tube of claim 1, wherein the flexible fabric comprises a geotextile material.

8. The tube of claim 7, wherein the geotextile material comprises at least one of polypropylene, polyethylene, or polyester.

9. The tube of claim 1, further comprising at least one anchor tie attached to a bottom portion of the tube body.

10. The tube of claim 1, wherein the two non-rigid end panels are attached to the two opposing ends of the tube body by at least one of sewing, heat seaming, welding, or gluing.

11. The geotextile tube of claim 1, wherein the geotextile tube is a dewatering tube.

12. The tube of claim 1, wherein the flat ends are perpendicular to a longitudinal axis of the tube body.

13. A geotextile tube comprising a flexible fabric and having flat ends adapted to receive a fill material, comprising:

a. a tube body comprising the flexible fabric and two opposing ends, wherein the tube body is formed from a single panel of the flexible fabric comprising opposing longitudinal edges and opposing lateral edges, wherein the opposing longitudinal edges are secured to one another;

b. two non-rigid end panels each comprising the flexible fabric and each one of which is attached to each of the opposing ends of the tube body to form the geotextile tube, wherein:

upon receipt of the fill material, the geotextile tube is adapted to assume a tube shape having flat ends, the flat ends are formed by the two non-rigid end panels, and the flexible fabric of the geotextile tube is self-supporting of the tube shape;

(c) at least one attachment tie secured to each non-rigid end panel or to each opposing end of the tube body adjacent to each non-rigid end panel; and (d) at least one fill port associated with a top portion of the tube body and configured to receive the fill material, wherein the geotextile tube is water-permeable.

14. The geotextile tube of claim 13, wherein the geotextile tube is a dewatering tube.

15. A method of forming a flexible water-permeable tube comprising a flexible water-permeable material, comprising:

(a) determining conditions of an environment into which the tube will be installed;

(b) providing the flexible water-permeable material;

(b) forming a tube body comprising two opposing ends from the flexible water-permeable material to form the tube;

(c) forming two non-rigid end panels from the flexible water-permeable material; and (d) securing one of the two non-rigid end panels to each of the opposing ends of the tube body, wherein:

upon receipt of the fill material, the tube is adapted to assume a tube shape having flat ends, the flat ends are formed by the two non-rigid end panels, and the flexible water-permeable material is self-supporting of the tube shape.

16. The method of claim 15, wherein determining conditions of an environment comprises:

(a) determining a height of the tube;

(b) determining a circumference of the tube body;

(c) acquiring a specific weight of the fill material; and (d) acquiring a specific weight of material surrounding the tube upon installation.

17. The method of claim 16, wherein forming two non-rigid end panels comprises:

(a) determining a cross-sectional shape of the tube body; and (b) manufacturing two non-rigid end panels from the flexible water-permeable material having a shape corresponding to the cross-sectional shape of the tube body.

18. The method of claim 17, wherein determining the cross-sectional shape of the tube body comprises determining a relationship between the circumference of the tube body, the height of the tube, the specific weight of the fill material, and the specific weight of the material surrounding the tube upon installation.

19. The method of claim 15, wherein forming the tube body comprising opposing ends further comprises:

(a) forming a panel from the flexible water-permeable material having two opposing longitudinal edges and two opposing lateral edges; and (b) securing the two opposing longitudinal edges to one another.

20. The method of claim 15, further comprising forming at least one fill port along the tube body.

21. The method of claim 15, further comprising forming and attaching at least one attachment tie along each non-rigid end panel or to the tube body adjacent to each non-rigid end panel after securing one of the two non-rigid end panels to each of the opposing ends of the tube body.

22. The method of claim 15, wherein securing one of the two non-rigid end panels to each of the opposing ends of the tube body is done by at least one of sewing, heat seaming, welding, or gluing the non-rigid end panels to the opposing ends to form a seam.

23. The method of claim 22, wherein the seam is at least one of a flat, butterfly, J, or overlap.

24. The method of claim 15, wherein the flexible water-permeable tube is a dewatering tube.

25. The method of claim 15, wherein the flat ends are perpendicular to a longitudinal axis of the tube body.

26. A method of forming a geoxtextile tube comprising a water-permeable geotextile material, comprising:

(a) determining conditions of an environment into which the tube will be installed, comprising:

(i) determining a height of the tube;

(ii) determining a circumference of the tube;

(iii) acquiring a specific weight of the fill material; and (iv) acquiring a specific weight of material surrounding the tube upon installation;

(b) providing the water-permeable geotextile material;

(c) forming a tube body, comprising:

(i) forming a panel from the water-permeable geotextile material comprising two opposing longitudinal edges and two opposing lateral edges, wherein a length along one of the opposing lateral edges of the panel equals the circumference of the tube; and (ii) securing the two opposing longitudinal edges to one another, wherein the tube body comprises two opposing ends;

(d) forming two non-rigid end panels from the geotextile material, comprising:

(i) determining a cross-sectional shape of the tube body when filled with the fill material and placed in the environment, wherein the cross-sectional shape is determined by a relationship between the circumference of the tube, the height of the tube, the specific weight of the fill material, and the specific weight of the material surrounding the tube upon installation; and (iii) manufacturing two non-rigid end panels from the water-permeable geotextile material comprising a shape corresponding to the cross-sectional shape of the tube body;

(e) securing one of the two non-rigid end panels to each of the two opposing ends of the tube body;

(f) forming at least one fill port along an upper portion of the tube body; and (g) forming at least one attachment loop along each non-rigid end panel, wherein:

upon receipt of the fill material, the geotextile tube is adapted to assume a tube shape having flat ends, the flat ends are formed by the two non-rigid end panels, and the geotextile material of the geotextile tube is self-supporting of the tube shape.

27. The method of claim 26, wherein the geoxtextile tube is a dewatering tube.

28. A method of installing an erosion prevention barrier, comprising:

(a) preparing an area for installation;

(b) providing a first and second flexible water-permeable tube, each tube comprising a flexible fabric and having a tube body and two non-rigid end panels, each of the non-rigid end panels comprising the flexible fabric, wherein:

upon receipt of a fill material, the flexible water-permeable tube is adapted to assume a tube shape having flat ends, the flat ends are formed by the two non-rigid end panels, and the flexible fabric of the flexible water-permeable tube is self-supporting of the tube shape, each tube further comprising:

(i) at least one fill port; and (ii) at least one attachment tie for each flat end;

(c) filling the first tube with the fill material through the at least one fill port;

(d) placing one of the two flat ends of the second tube adjacent to one of the two flat ends of the first tube;

(e) securing the at least one attachment tie of the flat ends of the first and second tubes adjacent to one another together; and (f) filling the second tube with the fill material through the at least one fill port.

29. The method of claim 28, wherein the non-rigid end panels have a shape corresponding to a cross-sectional shape of the tube body when the tube body is filled with the fill material and installed.

30. The method of claim 29, wherein the cross-sectional shape of the tube body is determined by a relationship between a circumference of the tube, a height of the tube, a specific weight of the fill material, and a specific weight of material surrounding the tube upon installation.

31. The method of claim 28, wherein the tube body and the non-rigid end panels are formed from a geotextile material.

32. A method of installing an erosion prevention barrier, comprising:

(a) preparing an area for installation comprising:

(i) removing debris;

(ii) leveling an installation surface; and (iii) installing a scour skirt;

(b) providing a first and second water-permeable geotextile tube, each geotextile tube comprising a flexible fabric and comprising:

(i) a water-permeable tube body comprising the flexible fabric and two opposing ends;

(ii) opposing non-rigid end panels, each comprising the flexible fabric and each one of which is secured to the two opposing ends of the tube body, wherein:

upon receipt of a fill material, the geotextile tube is adapted to assume a tube shape having flat ends, the flat ends are formed by the two non-rigid end panels, and the flexible fabric of the geotextile tube is self-supporting of the tube shape;

(iii) at least one fill port associated along an upper portion of the tube body;

(iv) at least one attachment tie attached to the tube proximate one of the opposing flat ends of the tube; and (v) at least one anchor tie attached along a bottom portion of the tube body;

(c) securing the first tube in the area by securing the at least one anchor tie to an anchor;

(d) filling the first tube with the fill material through the at least one fill port;

(e) placing one of the opposing non-rigid flat ends of the second tube adjacent to one of the opposing non-rigid flat ends of the first tube;

(f) securing the attachment ties of the non-rigid flat ends of the first and second tubes adjacent to one another together; and (g) filling the second tube with the fill material.

33. A method for making a non-rigid end panel for a water-permeable geotextile tube, the geotextile tube comprising a flexible fabric and adapted to receive a fill material, comprising:

(a) determining a cross-sectional shape of the water-permeable geotextile tube when filled with the fill material and placed in an environment;

(b) creating a full-scale pattern having the cross-sectional shape; and (c) using the full-scale pattern to manufacture the non-rigid end panel, wherein:

upon receipt of the fill material, the geotextile tube is adapted to assume a tube shape having flat ends, one of the flat ends is formed by the non-rigid end panel, and the flexible fabric of the geotextile tube is self-supporting of the tube shape.

34. The method of claim 33, wherein determining the cross-sectional shape of the water-permeable geotextile tube further comprises:

(a) selecting a height (H) and a circumference (L) for the tube;

(b) determining a specific weight of the fill material ($SW_{int}$) and material surrounding the tube upon installation ($SW_{ext}$); and (c) calculating the cross-sectional shape utilizing an algorithm, the algorithm comprising:

(i) dividing H by L of the tube to create a non-dimensional value of the height of the tube (h);

(ii) solving for a value of k in the equation $$\frac{1}{2[K(k)-E(k)]}=\frac{h}{\left(1-\sqrt{1-k^2}\right)}$$

by using h, wherein K(k) and E(k) are complete elliptic integrals of a first and second kind and k is an unknown parameter;

(iii) solving for $p_{bot}$ in the equation $$p_{bot}=\frac{1}{2[K(k)-E(k)]}$$

by using k, wherein $p_{bot}$ is a non-dimensional value of a pressure applied at a bottom portion of the tube (P); and (iv) using k and $p_{bot}$ to calculate the cross-sectional shape by generating dimensional values of the cross-sectional shape, using elliptic integrals to plot the cross-sectional shape, or using non-elliptic integrals to plot the cross-sectional shape.

35. The method of claim 34, wherein using non-elliptic integrals to plot the cross-sectional shape comprises:

(a) solving for t in equation $$k=\frac{2\sqrt{t}}{p_{bot}}$$

by using k and $p_{bot}$, wherein t is a non-dimensional value of a circumferential tension per width perpendicular to a cross section of the tube (T);

(b) generating a plurality of corresponding x and y coordinates by varying r between 0 and 2π and using t, $p_{bot}$, L, and J in formulas:

$$y(r)=L\left[p_{bot}-\sqrt{(p_{bot}^2-2t+2t\cos(r))}\right] \text{ and}$$

$$x(r)=L\left(\frac{b}{2}+tJ\right), \text{ wherein } J=\int_0^r\frac{\cos(r)}{\sqrt{(p_{bot}^2-2t+2t\cos(r))}}dr;$$

and (b) plotting the plurality of corresponding x and y coordinates.

36. The method of claim 34, wherein generating the dimensional values of the cross-sectional shape comprises:

(a) solving for t in the equation $$k=\frac{2\sqrt{t}}{p_{bot}}$$

by using k and $p_{bot}$, wherein t is a non-dimensional value of a circumferential tension per width perpendicular to a cross section of the tube (T);

(b) solving for b from equation $b=1-2k\sqrt{t}K(k)$ by using k and t, wherein b is a non-dimensional value of a width of a contact area between the tube and a supporting surface (B);

(c) solving for w from equation $$w=b+2\left[E(\pi/4,k)-\left(1-\frac{k^2}{2}\right)F(\pi/4,k)\right]p_{bot}$$

by using b, k and $p_{bot}$, wherein $$F(\pi/4,k) \text{ and } E\left(\frac{\pi}{4},k\right)$$

are elliptic integrals of a first kind and second kind and w is a non-dimensional value of a width of the tube at the tube's widest part when filled (W);

(d) solving for a from equation $a=bp_{bot}$ by using b and $p_{bot}$, wherein a is a non-dimensional value of a cross section area of the tube (A); and (e) calculating dimensional values of T, B, W, and A from non-dimensional values t, b, w, and a, wherein $T=SW_{int}L^2$, $W=wL$, $B=Lb$, $A=aL^2$, and $$\underline{P_{bot}}=p_{bot}SW_{int}L.$$

37. The method of claim 34, wherein using elliptic integrals to plot the cross-sectional shape comprises:

(a) generating a plurality of corresponding x and y coordinates by using k and $p_{bot}$ in equations:

$$x=\left[E(\phi,k)-\left(1-\frac{k^2}{2}\right)F(\phi,k)\right]p_{bot}$$

and $y=(1-\sqrt{(1-k^2\sin^2\phi)})p_{bot}$ while varying φ between 0 and π, wherein F(φ,K) and E(φ, k) are elliptic integrals of a first kind and second kind; and (b) plotting the plurality of corresponding x and y coordinates.

* * * * *